US006981507B2

(12) United States Patent
Gabriele-Baumann

(10) Patent No.: US 6,981,507 B2
(45) Date of Patent: Jan. 3, 2006

(54) CHILD'S BARRETTE AND METHOD OF APPLICATION

(76) Inventor: Lucia Gabriele-Baumann, 45 Wentick St., Totowa, NJ (US) 07512

( * ) Notice: Subject to any disclaimer, the term of this patent is extended or adjusted under 35 U.S.C. 154(b) by 0 days.

(21) Appl. No.: 10/388,116

(22) Filed: Mar. 12, 2003

(65) Prior Publication Data

US 2003/0172948 A1 Sep. 18, 2003

Related U.S. Application Data

(63) Continuation-in-part of application No. 09/670,302, filed on Sep. 26, 2000, now abandoned.

(51) Int. Cl.
*A45D 8/12* (2006.01)

(52) U.S. Cl. ..... 132/275; 132/278

(58) Field of Classification Search ..... 132/275, 132/273, 278, 279; D28/39, 40, 41, 42, 43
See application file for complete search history.

(56) References Cited

U.S. PATENT DOCUMENTS

| | | | | |
|---|---|---|---|---|
| 1,864,199 | A | 6/1932 | Kahn | |
| 2,699,798 | A | 1/1955 | Hawkins, Jr. | 137/246.16 |
| 2,818,871 | A | 1/1958 | Beaudry | 132/48 |
| 3,086,529 | A | 4/1963 | Munz et al. | 128/327 |
| 3,542,041 | A | 11/1970 | Mercorella | 132/46 |
| 3,940,873 | A | 3/1976 | Lawless | 43/57.5 R |
| 3,998,233 | A | 12/1976 | Dorr | 132/48 |
| 4,165,555 | A | 8/1979 | Boxer et al. | 24/204 |
| 4,414,991 | A | 11/1983 | Marcotte | 132/45 R |
| D280,942 | S | 10/1985 | Topalian | D28/42 |
| 4,896,685 | A | 1/1990 | Lawrence | 132/278 |
| 4,907,352 | A | 3/1990 | Ginsberg | 36/50 |
| 4,913,174 | A | 4/1990 | Cusenza | 132/278 |
| D318,540 | S | 7/1991 | Carter | D28/42 |
| 5,062,436 | A | 11/1991 | Emsellem | 132/279 |
| 5,097,854 | A | 3/1992 | Smith | 132/275 |
| 5,458,109 | A | 10/1995 | Tu | 132/279 |
| 5,477,870 | A | 12/1995 | Menaged | 132/279 |
| 5,671,517 | A | 9/1997 | Gourley | 24/712.1 |
| 5,857,469 | A | 1/1999 | Sowell | 132/275 |
| 5,862,814 | A | 1/1999 | Janik et al. | 132/275 |

(Continued)

OTHER PUBLICATIONS

"Wee Bow" brochure, Wimpole Street Creations, 1999.*

*Primary Examiner*—Todd E. Manahan
(74) *Attorney, Agent, or Firm*—Ernest D. Buff & Associates LLC; Ernest D. Buff; Theodore J. Piersou

(57) ABSTRACT

Fine or short hair is held in place by a barrette having a fastener material known as Velcro®, comprising hook and loop portions. The barrette comprises a flat strip of flexible material having a decorative upper surface and a lower surface. One end of the strip's lower surface is attached to the hook portion of the fastener material. The loop portion of the fastener material is attached to the lower surface of the other end of the strip. Releasable contact between the hook and loop portions of the fastener material is achieved by bending the strip about a line perpendicular to its length, with the short, fine, curly or kinky hair being trapped by and held between the complementary surfaces of the fastener material. The hooks and loops of the fastener material are closely spaced so that constraining forces are applied to individual hair filaments or small hair filament groups. Fastening is facilitated, optionally by a snap attachment. The holding power of the barrette is enhanced, and discomfort formerly associated with application and use of hair fasteners is minimized.

17 Claims, 2 Drawing Sheets

U.S. PATENT DOCUMENTS

| | | | | |
|---|---|---|---|---|
| 5,913,316 | A | 6/1999 | Chou | 132/275 |
| 5,979,466 | A | 11/1999 | Chung | 132/275 |
| 6,000,409 | A | 12/1999 | Chung | 132/278 |
| 6,003,522 | A | 12/1999 | Schach | 132/279 |
| 6,024,102 | A | 2/2000 | Huang | 132/273 |
| D422,750 | S | 4/2000 | Chou | D28/41 |

* cited by examiner

CHILD'S BARRETTE AND METHOD OF APPLICATION

This application is a continuation-in-part of U.S. application Ser. No. 09/670,302, filed Sep. 26, 2000, now abandoned.

BACKGROUND OF THE INVENTION

1. Field of the Invention

This invention relates holding devices; and more particularly to a hair fastener or barrette and method for application thereof to the head of a person, such as a child having fine curly kinky or short hair, to form from the body of hair a neat coherent mass that enhances comfort and appearance of the wearer, and avoids discomfort oftentimes experienced during the fastening process and continued discomfort during use.

2. Description of the Prior Art

Hair fasteners and barrettes have long been in use and are described for example in U.S. Pat. Nos. 1,864,199; 3,542,041; 3,998,233; Des. 280,942; Des. 318,540; 5,062,436; 5,097,854; 5,458,109; 5,477,870; 5,857,469; 5,862,814; 5,913,316; 5,979,466; 6,00,409; 6,003,522, 6,024,102, Des. 422,750, and others. Each of these hair fasteners functions by applying constraint external to a sizeable body or lock of hair, which features are generally not available in a child's hair.

For example, in using the barrette disclosed by U.S. Pat. No. 1,864,199, a lock of hair is gathered and constrained by a metal clip.

In U.S. Pat. No. 5,097,854 there is disclosed a method wherein a bundle of hair such as a ponytail is first constrained by an elastic band and then by a loop of flexible material. However, when a person has fine hair or short hair, it is a common experience that this manner of constraint fails to hold the hair. Velcro fastener materials have been used to prevent barrettes from opening. In such fasteners, elements other than Velcro fastener materials are applied directly to the hair to constrain it. None of the previous uses of Velcro fastener materials involves the direct application thereof to the hair; there exists no previous disclosure wherein the advantages of doing so have been foreseen.

U.S Pat. No. 4,896,685 to Lawrence discloses a baby bow hair fastener. The hair lock of the fastener includes two elongated flexible plastic strips having one of the ends laser welded and the other end open. The elongated flexible strips are formed with male and female locking elements, which locking the baby's hair. This device applies a large amount of force on the hair elements, which have to be essentially straight to be secured within this male and female capture element. During use of the fastener, a portion of the baby's hair tends to be harshly pulled by the capture element, causing discomfort.

U.S. Pat. No. 4,414,991 to Marotte discloses a hair-cutting tool wherein hair is combed and held between two panels, which carry hook and loop (Velcro™) strips. These panels are rigid, and are designed to hold the combed air steady using a Velcro™ clamp on one end and a hinge on other end. The contour of the panels are shaped in a wavy manner, so that the clamped hair within the panels containing Velcro fastener material can be cut in a scalloped form. Such panels to be not well suited for holding a child's fine hair. They are much too heavy and are predominantly directed to holding long lengths of thick hair that can be combed straight. Such properties are oftentimes not present in a child's hair, which is generally fine, short, kinky and curled. For these reasons, use of Marcotte's hair-cutting tool on a child's hair might result in extreme discomfort to a child during the attachment and during use phases.

U.S. Pat. No. 4,165,555 to Boxer et al. discloses a pair of flexible pile patching having hook and loop portions permanently attached to a pair of socks. Flexible material in-between the strips is used to form a hinge. Each of the socks is detachably attached, by matching the hook from one sock of the pair with the loop portion of the other sock of the pair to thereby create a removable attachment. Hair is not present in-between the hook and loop portions, and the Boxer et al. device is not a child's hair barrette. The Boxer et al. teaching is, instead, directed to commercial availability of a Velcro strip of material having hook and pile portions, the material having in the form of two parallel strips.

U.S. Pat. No. 2,818,871 to Beaudry discloses a hair barrette, which uses flexible strip carrying ribs to capture hair. The plate has a reduced medial thickness to create a hinge so that the strip can be folded over itself and held secure by a locking post that passes through an aperture. A well-combed straight hair lock is clamped between the ribs captured in place by the locking post. This clamping action requires a substantial amount of combed straight hair, which is not usually available in a child's hair. Also, the clamping action requires bending of the strip to generate clamping load, which can be substantial. This load could pull on one or more single hair elements clamped within the hair lock, creating discomfort to the wearer. Discomfort becomes even more intense when short, fine hair is clamped by the Beaudry device.

U.S. Pat. No. 2,699,798 to Goodman discloses a pigtail barrette or clamp. The barrette is made from two ornamentally shaped flexible panels, which are hinged; and carries a clasp. Different hair thicknesses are accommodated by a flexible panel. This panel provides substantial loading on the hair. It prevents sliding of hair, causing the hair strands to be essentially straight. Hair must be substantial straight to effect clasping; and the panels are bend to create the clasping force. Accordingly, the Goodman device is not suitable for use on a child's hair, which is sparse, fine, short, curly or kinky.

Short hairs cannot be gathered into a sufficient mass to be constrained by existing barrettes and fine hairs readily slip through a conventional barrette, since they rely on clasping a bundle of hair. When the wearer is a young child whose hair is sparse, short and fine, conventional barrettes fail to remain in place. Moreover, the necessity for fashioning a barrette which facilitates quick and painless application to young wearers is readily apparent. Moreover, a barrette needs to be low in weight, so that it does not apply stress to the hair during attachment and use. The barrette should clamp the hair without requiring it to be combed straight to facilitate attachment, since the child's hair length is small, becomes curled more often and has a fine texture. A barrette should also have low weight so that it does not apply undue loading on hair strands. It should attach gently to mini-locks of hair and, at the same time, preclude the any tendency for sliding, which is especially prevalent with heavy barrettes.

Accordingly, there exists a need in the art for a hair fastener that is suitable for persons having fine or short hair, and which minimizes discomfort experienced during application and continued use to young wearers such as children and infants.

SUMMARY OF THE INVENTION

The present invention provides a hair fastener or barrette especially suited for a young wearer such as a child having fine or short hair with a tendency to kink or curl. The child's barrette of the subject invention is lightweight and applies minimal pressure to a collected mini-lock of hair. As such, it accommodates the curly, kinky character of an infant's hair without need for passing a comb therethrough or otherwise straightening the hair. Attachment and use of the barrette is accomplished with little or no pulling on the hair. Forces in-between the flexible hook and loop members are minimized. Curled or kinky mini-locks of hair are held securely between the hook and loop members without having to be combed straight. When fastened by the wearer, the barrette applies constraint at the level of individual hairs of a mini-lock or small groups of hair filaments without requiring them to be combed parallel. Fastening is facilitated by multiple elements of the hook and loop fasteners. The barrette's holding power is enhanced by multiple engagement of hook and loop elements. Owing to the reduced overall weight of the barrette and reduced load applied when fastening a hair mini-lock, discomfort heretofore experienced during and after fastening is virtually eliminated.

Generally stated, there are provided a barrette for holding in place fine or short, curly, kinky hair and a method for its application. In a first embodiment, the barrette comprises a flat strip of flexible material, which can be bent readily on a line perpendicular to its length. Approximately a third of the length of the bottom surface flexible strip carries the hook portion of a Velcro strip and approximately a third of the length of the bottom surface flexible strip in the opposite side carries the loop portion of the Velcro strip. Both these Velcro strips are attached to the flexible strip using flexible glue such as rubber cement or alternative means of attachment such as ultrasonic welding, stapling and the like. The central space between the Velcro strips on the bottom surface of the flexible flat strip is devoid of any Velcro fastener material. This Velcro fastener material-fee space exists at points where the flexible strip is bent on a line perpendicular to the length of the strip to effectively engage the hook and loop portions of the Velcro strip. In order to facilitate bending, a portion of the central space may have a reduced section. During use, fine, short, kinky and curly child's hair is simply placed on either the hook or loop portion of the bottom surface of the flexible flat strip. The flexible strip is then folded in the Velcro-free space on a line perpendicular to the length of the strip to engage the hook and loop portions of the flat flexible strip. Mini-locks of child's hair are thereby secured within the multiple hooks and loops of the Velcro strip. These hooks and loops are closely spaced, so that the low magnitude of constraining forces is applied to individual hair filaments or small groups of curled or kinky hair filaments. The top surface of the flexible strip opposed to the surface carrying the Velcro strips may be decoratively designed or fixedly attached to a decorative element.

The top and bottom edges along the length of the barrette are substantially linear.

In a second embodiment, there is provided a barrette for holding in place fine or short hair. The barrette is constructed and operates in substantially the same manner as the first embodiment; but further includes opposable releasable snap fastening means are added to the first embodiment located at the distal ends of the flexible strip. This snap mechanism holds the child's hair with additional forces in addition to the constraint provided by the hook and loop strip.

More specifically, a first embodiment of the invention comprises a barrette for holding in place fine or short hair, comprising a flat strip of flexible material having a length ranging from about one inch to about three inches, a width ranging from about one-eighth of an inch to about one half of an inch, an upper surface, a lower surface, a left end, a center region and a right end. The overall weight of the device ranges from 0.05 oz to 0.2 Oz since the comfort level is related to the pull exerted by the weight of the barrette device. The lower surface is rigidly attached to complementary, opposable, releasable fastening means of the hook and loop type known as Velcro. The left end of the lower surface is fixedly attached to the hook portion of the Velcro fastening means; the right end of the lower surface is fixedly attached to the loop portion of the Velcro fastening means. Less than about 33% of the lower surface of the center region is devoid of Velcro. The hair is simply placed on the hook or loop portion of the flexible strip and the flexible strip is bent perpendicular to its length to engage the hook and loop pile with entrapped hair.

A second embodiment of the invention comprises a barrette for holding in place fine curly kinky or short hair similar to the first embodiment, but in addition to Velcro strips, carries a snap fastening means added at distal ends of the flexible strip. This requires that the bend be made at a precise location to engage the snap mechanism. This may be accomplished by molding a reduced thickness line in the flexible strip to guide the bending action reliably. Here again, the hair is simply placed on the hook or loop portion of the flexible strip and the flexible strip is bent perpendicular to its length to engage the hook and loop pile with entrapped hair. The light weight of the device is a salient feature. It enables application of minimal pull to the child's hair. At the same time, a "holding action" applied at the mini-loop level provides holding functionality sufficient to secure fine, curly, or kinky short hair.

Yet a further embodiment of the invention comprises a method for constraining a lock of hair. Generally stated, the method comprises the steps of: (i) placing the lock of hair between the surfaces of an opposable, releasable fastening means of the hook and loop type known as Velcro fastener material attached to a surface of a flexible strip; and (ii) clamping the opposable surfaces of the Velcro fastener material together with the hair trapped by and between the hooks and loops of the attached to a flexible strip. Optional holding may be additionally provided by snap fastening means located at distal ends of the flexible strip.

BRIEF DESCRIPTION OF THE DRAWINGS

The invention will be more fully understood and further advantages will become apparent when reference is had to the following detailed description and the accompanying drawings, in which.

DETAILED DESCRIPTION OF THE INVENTION

Figure 1A:
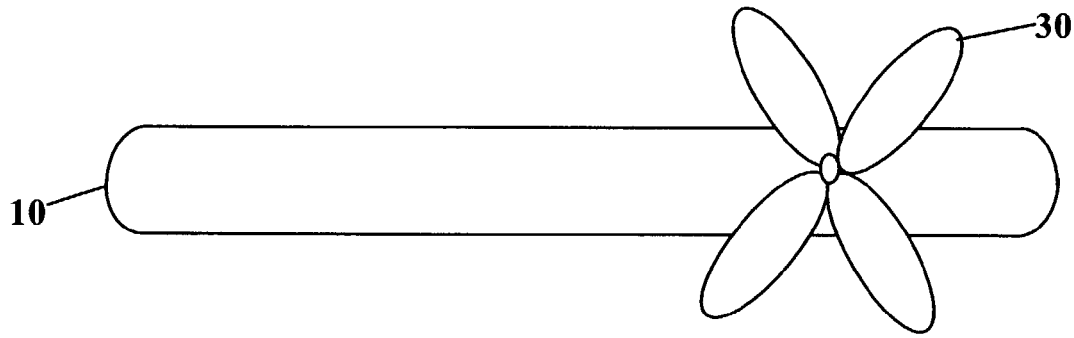
FIG. 1*a* is a plan view of the top surface of a first barrette of the invention.

When parents of infants and toddlers take their children into social settings, they oftentimes announce the gender of their child using established dress codes. Generally, for female children, these dress codes include various styles of hair decoration. Frequently, an infants' hair is short, fine, curly, kinky and sparse. At birth, an infants' hair is rarely more than two centimeters in length and cannot be combed to entrap the hair in a barrette. Indeed, a large percentage of newborn hair is lost in the weeks following birth. Scalp hair grows in active and resting cycles of about two to four years in length. Hair growth rate in the active phase is only about 0.37 millimeter (mm) per day. For a period of some years then, a parent wishing to style and decorate a daughter's hair encounters troublesome problems associated with constraining short and fine hair.

The application of a barrette to the fine, curly, kinky, short fine hair of a child frequently produces severe discomfort. The very act of applying the barrette to hair, especially short hair that is not easily combed, is difficult. A heavy weight produced by the barrette burdens sparse hair. The constant discomfort thereby provided oftentimes causes a child to repeatedly brush off such a hair holding device.

Conventional barrettes are designed to constrain fairly large masses of hair and do so by applying the constraining forces around the periphery of the mass. In many cases, short hairs cannot be gathered into a sufficient mass to be constrained by existing barrettes and fine hairs readily slip through the barrette. Frequently, a young child's hair is short, curly, kinky and fine. When applied to young children, conventional barrettes fail to remain in place due to their sizeable weight and insufficient hair holding power. Moreover, the difficulty of fastening conventional barrettes to children too often causes pain and discomfort to the wearer both during attachment and use.

The present invention utilizes fasteners of the hook and loop type known as Velcro fastener material bonded to a flexible plate; these fasteners are applied directly to kinky curly hair without need for combing. The reduced weight of the device due to its construction and the reduced clamping power provided by the Velcro fasteners provides a comfortable device for holding hair. The child's barrette does not easily slip down since the hair is essentially curled within multiple paths of Velcro pile and, unlike combed hair, there are no straight hair segments to slip through.

The hook and loops of Velcro fasteners are closely spaced at intervals of about 1 mm. A 1"×4" Velcro strip weighs 1.32 grams for the hook portion of the strip and 1.32 grams for the loop portion of the strip. Using a plastic flexible member with a mass of 1.5 grams on each side, the barrette can easily be made under 6 grams or approximately 0.2 Oz for a barrette which is 1 inch wide having a one and a half to two inch folded region for capturing child's hair. Reducing the width to half an inch reduces the weight to 0.1 Oz. Reducing it farther to 0.25 inches results in a barrette with a weight less than 0.05 Oz. A barrette which is quarter of an inch wide with a capture region of 1.5 to 2 inch is more than adequate for securing a child's hair. The light weight of the barrette applies minimal loading to the child's mini-lock hair, while providing a 1.5–2 inch wide region to capture mini-locks of hair.

When a lock of curly kinky fine hair that is not combed is secured between the hooks and loops of Velcro, the hair lock is separated into many smaller groups, which can comprise mini-locks or even individual hair filaments. Each "mini-lock" is captured by multiple hooks, causing its further subdivision, and becomes trapped against the opposing face of the Velcro strip. The size or mass of the lock of hair under constraint is immaterial, since the constraint is applied at the level of the mini-locks. Each mini-lock is subject to the multiple constraints imposed by the multiple hooks and loops of the Velcro. A high restraining force is thereby imparted to each hair filament and does not easily slip through. It has been found that the barrettes of the invention, which are very low in weight are highly effective fasteners especially well suited to constrain the fine and short hair of infants and children. Advantageously, barrettes constructed and applied in accordance with the invention exhibit hair fastening and retention capability far surpassing that of conventional barrettes, with very little or no discomfort to the child either during attachment or subsequent use.

The barrettes described herein can, of course, be modified in numerous ways without departing from the scope of the invention. Many of these modifications will be evident to one skilled in the art. Consequently, it would be impractical to discuss every one of them. Accordingly, it will be appreciated that the variations shown and described hereinafter are representative, and should not be construed as limiting the scope of the invention.

Figure 1B:
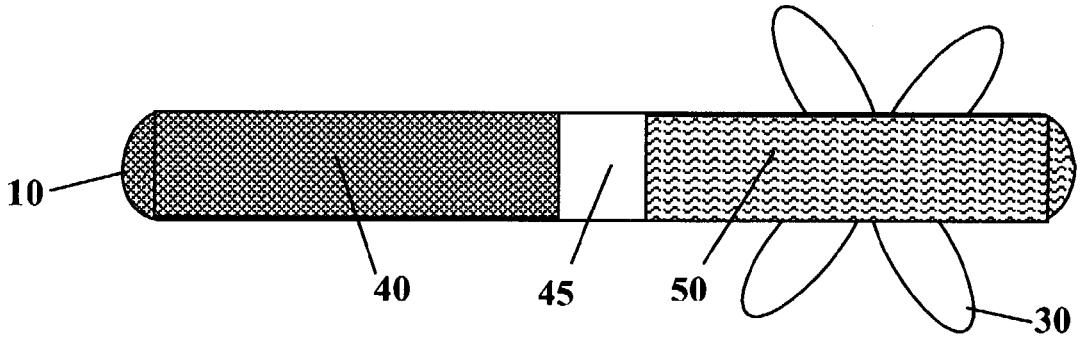
FIG. 1*b* is a plan view of the bottom surface of the barrette shown in FIG. 1*a*, depicting opposable releasable fastening means fixedly attached to the bottom surface.

In FIGS. 1*a* and 1*b* there is illustrated a first embodiment of a barrette in accordance with the invention. The barrette 10 comprises a flat flexible strip of flexible material having a length ranging from about one inch to about six inches, and a width ranging from about one-quarter of an inch to one inch. These dimensional ranges are critical to the application for which the invention is intended. Preferably, the length of the flat flexible strip is at least twice its width. The material of which the flat flexible strip is constituted may be fabric, elastomer or plastic, or a composite of these or other materials. It is important that the material of the flexible strip be sufficiently flexible that the barrette may be readily folded about a line perpendicular to its length with ease. Preferably, the barrette is a plastic such as polyethylene, polypropylene or flexible vinyl. Complementary opposable releasable fastening means of the hook and loop type known as Velcro are fixedly attached to the bottom surface of the barrette using flexible glue such as rubber cement. Alternatively, the Velcro fastener material may be fixedly attached to the flexible strip by means of glue, rivets, ultrasonic welding or the like. The hook portion of the Velcro fastener material 40 is fixedly attached to the left end of the bottom surface and the loop portion of the Velcro fastener material 50 is fixedly attached to the right end of the bottom surface. A center region 45 about which the flexible material may be folded is devoid of Velcro. Optionally, a decorative element 30 is fixedly attached to the top surface of the flexible strip, or the top surface of the strip may itself be decorative.

As shown in FIGS. 1*a* and 1*b*, the top and bottom edges along the length of the barrette are substantially linear.

As shown in FIGS. 1*a* and 1*b*, the top and bottom edges along the length of the barrette are substantially linear.

Figure 2A:
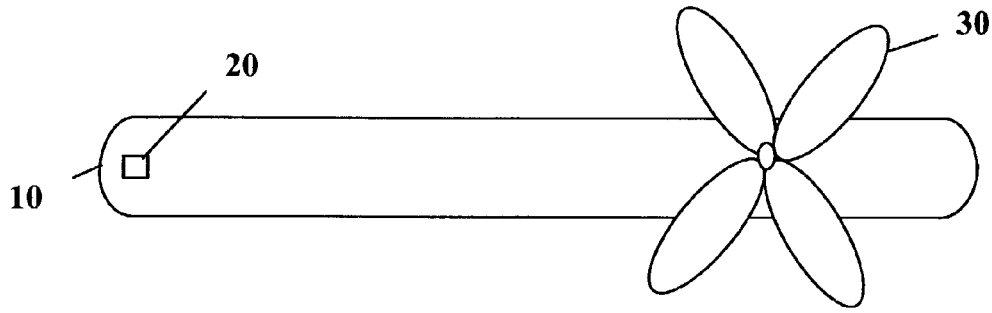
FIG. 2*a* is a plan view of a second barrette of the invention.
Figure 2B:
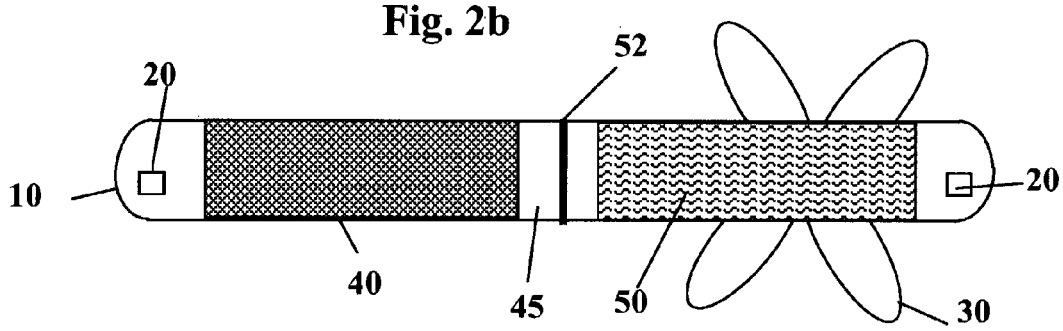
FIG. 2*b* is a plan view of the bottom surface of the barrette shown by FIG. 2*a,* depicting an opposable releasable snap fastener means at the distal ends of the barrette.
Figure 2C:
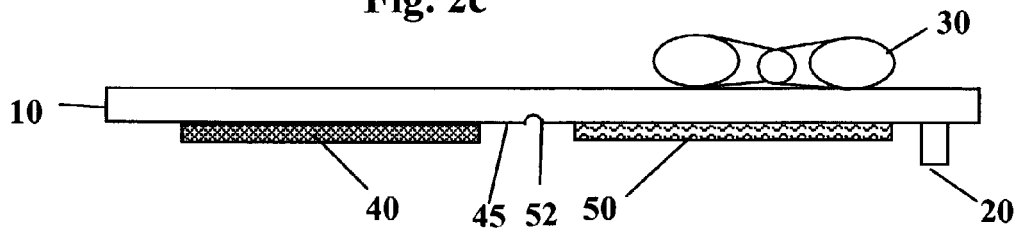
FIG. 2*c* is a side view of the second barrette further depicting the opposable releasable snap fastener means.

FIGS. 2*a,* 2*b* and 2*c* illustrate a second embodiment of a barrette in accordance with the invention. This embodiment consists of the same elements as that shown in FIGS. 1*a* and 1*b;* but additionally comprises an opposable releasable snap fastener 20 located at the distal ends of the barrette. Use of snap fastener 20 provides further assurance that closure of the barrette is secure. As illustrated by FIGS. 2*a* through 2*c,* the fastener is of the post and socket snap variety. This fastener design is preferred since it is easily and economically molded into the flexible strip. It will be obvious to one skilled in the art that other snap fastener designs may be employed without departing from the scope of the invention. A central depression or groove 52 is provided, as shown in FIGS. 2*b* and 2*c,* to assist bending of the flexible strip so that the snap fastener attaches properly and reliably.

As shown in FIGS. 2*a* and 2*b*, the top and bottom edges along the length of the barrette are substantially linear.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A barrette for holding in place sparse fine, short, curly or kinky child's hair, comprising:

a. a flat strip of flexible polymeric material having a length ranging from about one inch to about six inches and a width ranging from one-fourth inch to about one inch, said strip having an upper surface, a lower surface, a left end, a center region, a right end, a top edge and a bottom edge;

b. complementary, opposable, releasable fastening means comprising hook and loop portions of fastener material separately and fixedly attached to said lower surface c. said left end of the lower surface of said strip being separately and fixedly attached to the hook portion of the fastening means;

d. said right end of the lower surface being separately and fixedly attached to the loop portion of the fastening means;

e. said center region, constituting more than about 5% and less than about 33% of said lower surface, being devoid of fastener material;

f. said barrette having a weight ranging from 0.05 to 0.2 oz; and g. each of said top and bottom edges being substantially linear.

2. A barrette for holding in place fine or short hair as recited by claim 1, wherein the said upper surface has an ornamental design drawn on or affixed to it.

3. A barrette for holding in place fine or short hair as recited by claim 1, wherein distal ends of the said lower surface are provided with opposable, releasable snap fastening means.

4. A barrette for holding in place fine or short hair as recited by claim 1, wherein said flat strip of flexible material has a length ranging from about one inch to about five inches.

5. A barrette for holding in place fine or short hair as recited by claim 1, wherein said flat strip of flexible material has a width ranging from about one-quarter inch to about one-half inch.

6. A barrette for holding in place fine or short hair as recited by claim 1, wherein said central region has a reduced cross section to facilitate bending.

7. A barrette for holding in place fine or short hair as recited by claim 1, wherein the weight of the barrette is 0.1 to 0.2 Oz.

8. A barrette for holding in place fine or short hair as recited by claim 1 wherein the flat strip of flexible polymeric material is composed of material selected from the group consisting of: polyethylene, polypropylene and flexible vinyl.

9. A method of applying a barrette of claim 1 for holding in place sparse, fine, curly, kinky, or short child's hair, comprising the steps of:

a. placing said hair directly on the hook or loop portion of the said barrette;

b. folding flat flexible strip on a line perpendicular to the length of the strip so that the hook and loop portions engage together entrapping the said child's hair.

10. A barrette for holding in place sparse fine, short, curly or kinky child's hair, comprising:

a. a flat strip of flexible polymeric material having a length ranging from about one inch to about six inches, a width ranging from one-fourth inch to about one inch having an upper surface, a lower surface, a left end, a center region, a right end, a top edge and a bottom edge;

b. said flat strip being provided with a snap attachment at said left and right ends;

c. complementary, opposable, releasable fastening means comprising hook and loop portions of fastener material separately and fixedly attached to said lower surface d. said left end of the lower surface of said strip being separately and fixedly attached to the hook portion of the fastening means;

e. said right end of the lower surface being separately and fixedly attached to the loop portion of the fastening means;

f. said center region, constituting more than about 5% and less than about 33% of said lower surface, being devoid of fastener material;

g. said central region having a depression or groove to assist bending of the said flexible strip in a line perpendicular to the length of the strip;

h. said barrette having a weight of 0.05 to 0.2 oz; and i. each of said top and bottom edges being substantially linear.

11. A barrette for holding in place fine or short hair as recited by claim 10, wherein the said upper surface has an ornamental design drawn or affixed to it.

12. A barrette for holding in place fine or short hair as recited by claim 10, wherein distal ends of the said lower surface are provided with opposable, releasable snap fastening means.

13. A barrette for holding in place fine or short hair as recited by claim 10, wherein said flat strip of flexible material has a length ranging from about one inch to about five inches.

14. A barrette for holding in place fine or short hair as recited by claim 10, wherein said flat strip of flexible material has a width ranging from about one-quarter inch to about one-half inch.

15. A barrette for holding in place fine or short hair as recited by claim 10 wherein the weight of the barrette is 0.1 to 0.2 Oz.

16. A barrette for holding in place fine or short hair as recited by claim 10 wherein the flat strip of flexible polymeric material is composed of material selected from the group consisting of: polyethylene, polypropylene and flexible vinyl.

17. A method of applying a barrette of claim 10 for holding in place sparse, fine, curly, kinky or short hair, comprising the steps of:

a. placing the said hair directly on the hook or loop portion of the said barrette;

b. folding the flat flexible strip on a line perpendicular to the length of the strip along the depression or groove so that the snap attachment, together with hook and loop portions, engage together to thereby entrap said hair.

* * * * *